US005324245A

United States Patent [19]

Fontana et al.

[11] Patent Number: 5,324,245

[45] Date of Patent: Jun. 28, 1994

[54] KNEE BENDING MACHINE

[76] Inventors: Anthony Fontana; Michelle Fontana, both of 8 Pilgrim Ct., West Trenton, N.J. 08628

[21] Appl. No.: 51,390

[22] Filed: Apr. 23, 1993

[51] Int. Cl.[5] ..... A63B 21/00

[52] U.S. Cl. ..... 482/131; 602/36; 482/142; 601/34

[58] Field of Search ..... 482/56, 72, 79, 131, 482/135, 137, 139, 142, 907, 130; 128/25 R; 602/35, 36

[56] References Cited

U.S. PATENT DOCUMENTS

| | | | |
|---|---|---|---|
| 902,946 | 11/1908 | De Nise | 482/131 |
| 964,886 | 7/1910 | Sickels | 482/131 |
| 1,329,660 | 2/1920 | Kaye | 482/56 |
| 3,373,993 | 3/1968 | Oja et al. | 128/25 R |
| 3,830,231 | 8/1974 | Klein | 128/25 R |
| 4,089,330 | 5/1978 | Nicolosi . | |
| 5,007,632 | 4/1991 | Wilkinson | 482/72 |
| 5,042,800 | 8/1991 | Walter | 482/142 |

FOREIGN PATENT DOCUMENTS

| | | | |
|---|---|---|---|
| 0356572 | 7/1922 | Fed. Rep. of Germany | 482/131 |
| 2621553 | 4/1989 | France | 482/72 |
| 0667083 | 9/1964 | Italy | 482/130 |
| 0820858 | 4/1981 | U.S.S.R. | 482/72 |

*Primary Examiner*—Richard J. Apley
*Assistant Examiner*—Jeanne M. Mollo
*Attorney, Agent, or Firm*—Abdallah & Muckelroy

[57] ABSTRACT

A knee stretching machine for physical therapy of the knee is set forth wherein a padded thigh seat is adjustably attached aft on a body length shaft oriented on the floor. Attached across the body length shaft is a transverse member with an eyelet at each end. A winch is secured to the fore of the body length shaft. Aft and in front of the winch are two other eyelets for receiving two ropes. One of the ropes is connected to an ankle collar via the eyelet on one end of the transverse member and the other rope is independently connected to the ankle collar via the eyelet on the other end of the transverse member. A patient lies face down and places the thigh of the knee requiring therapy in the seat and secures the ankle in the collar. The winch is cranked to bend the knee joint behind the patient's back through a tolerable degree of flexion.

10 Claims, 2 Drawing Sheets

KNEE BENDING MACHINE

BACKGROUND OF THE INVENTION

1. Field of the Invention

This invention relates to exercising devices and particularly to knee bending exercise devices adapted to rehabilitate a knee after surgery.

2. Description of the Prior Art

The prior art includes various publications and patents pertaining to exercise devices but none of the devices are particularly adapted to stretching the muscles controlling the knee and simultaneously bilaterally stabilizing the knee joint to avoid lateral injurious movements subsequent to knee surgery.

In 1974, a martials publication included an advertisement describing a STRETCHER-CIZER apparatus. The STRETCHER-CIZER comprises a leather harness connected to two overhead in line pullers via a rope. The STRETCHER-CIZER is designed as a leg muscle stretcher stretching the leg muscles and the joint at the junction between the leg and the torso.

Another leg stretching machine is illustrated in the May, 1980 issue of Black Belt Magazine. This leg stretcher entitled "G.U.S." is similarly adapted to stretch the hip joint and muscles which control the juncture between the leg and the torso. One illustration shows the device also used to harness both ankles to assist in sit ups.

U.S. Pat. No. 3,638,939 to Langley further discloses a simple bar-like device which includes rollers at each end hereof and an intermediate handle. The device is positioned between one's legs and pulled towards the abdomen forcing the legs further and further apart and stretching the muscles associated therewith in the same manner as the G.U.S. machine.

U.S. Pat. No. 3,834,694 to Pridgen relates to an apparatus also utilized pulleys wherein one leg is strapped to a mattress an the other leg is coupled to weights via overhead pulley system. A rope is also coupled to the weights through a one way clutch. The same patent further discloses a post which is gripped while the one moves his or her legs back and forth against spring bars mounted to the post. Also in the same general area are U.S. Pat. No. 4,046,373 to Kim which discloses a multipurpose frame for stretching one's legs and U.S. Pat. No. 4,111,415 to Reitano which discloses utilizing hand grips and foot grips to develop particular muscles for karate.

Black Belt magazine in its February, 1982 issue discloses another leg stretching machine called the "Hurley Stretch Rack" which again is a means improvised to provide stretching of the hip joint, particularly, the junction between the leg and the torso.

U.S. Pat. No. 4,132,404 to Wilson discloses a leg stretching apparatus comprising two movable platforms having ball casters with free movement in opposite directions, the platforms being joined by an appropriate coupling means. U.S. Pat. No. 4,139,193 to Felber et al further discloses a kick training aid for karate comprising an adjustable pole with a foot piece on the top thereof mounted for the universal movement on a base. The pole is extended to accommodate individuals of different heights. And, U.S. Pat. No. 4,277,062 to Lawrence discloses a leg stretching exercise device comprising a platform attached to a bar with pulleys attached to each end.

In 1984 U.S. Pat. No. 4,445,684 was issued to Ruff for a leg stretching device which includes a set fixed to a shaft having a winch connected to a slidably mounted spreader. In 1991 U.S. Pat. No. 4,988,096 was issued to Jones for a muscle stretching apparatus for stretching an individual's legs which utilizes a plurality of rings secured to an individual flexible lien with a weighted member secured at the other end thereof. Also, in 1991 U.S. Pat. No. 5,067,709 was issued to Christensen for a device for stretching and strengthening the muscles of the lower back and legs of a person in a supine position.

Another leg stretching machine to develop and assist a person performing the Chinese split was issued as U.S. Pat. No. 5,147,266 to Ricard in 1992. FIG. 3 of Ricard shows a winch connected to two independent left and right ropes with the purpose of bilateral stretching of the hip joints and the area wherein each leg adjoins the torso.

In 1992 U.S. Pat. No. 5,122,106 was issued to Atwood et al for a stretching device for stretching the muscles, tendons and joint capsules of the hip, thigh, calf, and foot by completely cradling the foot and allowing the leg to be swung upward from a supine position.

It has been determined in recent year that after knee surgery regular physical therapy enhances recovery and shortens the time for recovery, especially for surgery involving repair of torn ligaments in the knee. With the advent of greater emphasis on physical fitness and exercise and with more and more participation by older individuals in sports there has been a dramatic rise in ligamentous injuries involving the knee. After surgery and after an initial period of healing regular stretching of the muscles of the knee increases both the flexibility and range of motion of the muscles involved.

To avoid overtaxing and injury to the knee muscles after surgery gradual static exercise and gradual knee bending stretches are recommended to be used rather than dynamic stretches. In performing knee bending exercise it has been found to be difficult for either the exerciser or an assistant to apply a sturdy, safe load on the leg. Moreover, it is not possible to accurately apply the same directional purely rearward force against the leg and knee joint each tie the knee related muscles are to be stretched, thus the extent to which the knee related muscles are stretched non-laterally can vary considerably from day to day and time to time using exercise without and assisting apparatus to restrict lateral movement.

It is known that after a muscle is stretched to or near its maximum level for a period of time if maximum contraction of the muscle is made and the muscle has been allowed to relax, a proprioceptive neuromuscular facilitation phenomenon occurs whereby a dip in the muscle stretch reflex occurs so that the muscle can be stretched somewhat further.

It is desirable to flex the muscle so the knee joint while lying in a prone position. Moreover, it is desirable to bend at the knee by bending the leg strictly backwards and then strictly forward through a qualifiable range of motion which can be repeated to apply the same amount of rotation and force.

In another apparatus, a motorized swing arm is strapped to the lower leg or lower arm to move the distal section of the limb through a range of motion about the knee or elbow joint, thereby to provide physical therapy to increase the range of motion in a knee joint that has reduced mobility. An example of this related prior art type device is disclosed in U.S. Pat. No.

4,089,330. However, one drawback of this particular type of device is that it is large, cumbersome, and too expensive for individuals to purchase for home use. Moreover, this type of device also places a constant load on the body limb rather than simply holding the leg in a moderate bent position and allowing the leg to be straightened and relieved if necessary, thereby removing the possibility and fear of overstretching while in this position and thus not allowing the user to relax.

SUMMARY OF THE INVENTION

The novel knee stretching machine provides for physical therapy of the knee joint and at the same time bilaterally stabilizes the knee joint from lateral pressure to either side by utilizing a contoured padded thigh seat slidably attached aft of a body length shaft horizontally oriented. A transverse member with an eyelet at each end is attached across the body length shaft to form a cruciform structure. Located aft but in front of a winch attached to the body length shaft are two other eyelets for receiving two independent ropes extending from the winch. The two ropes ar attached to a collar mounted about the ankle associated with the knee for which stretching is to be performed. While the patient lies prone he or she cranks the winch thus pulling the ankle backwards and being the knee joint to a comfortable position. Obliquely vectored forces tug on the ankle with the lateral components balancing each other and the combined pulling force is directed parallel to the body length shaft and the body thereby avoiding any lateral motion of the ankle and knee. The winch is unwound and released to permit the stretched muscles in the thigh and knee area to relax after contracting so that the proprioceptive neuromuscular facilitation phenomenum can be employed to further stretch the muscles once the muscle stretch reflex has been reduced. The extent to which the knee muscle is stretched may be quantified by noting the number of turns of the winch an repeating same as multiples of turns or fractions thereof. Thus, there is provided a safe, controllable regime to progressively stretch the muscles of the knee.

It is therefore a primary object of this invention to provide a knee stretching machine for physical therapy of the knee after surgery which avoids lateral movement of the knee joint.

It is also another object of the invention to provide a knee stretching machine for physical therapy of the knee which fixes the knee and thigh in such a position while the body is lying prone so as to avoid any lateral movement of the knee an associated knee muscles.

It is also an object of the invention to provide a knee stretching machine for physical therapy of the quadriceps femoris and the hip flexor muscles, specifically, the iliopsoas.

It is an additional further object of the invention to provide a knee stretching machine which assists a knee surgery patient in gaining knee flexion range of motion wherein the patient has control of how much flexion is tolerated.

A further object of the invention to provide a knee stretching machine that is lockable into a position for a prolonged hold and which maintains the patient in a correct anatomical prone alignment It is also an object of the invention to provide a knee stretching machine which is easy to set up and disassemble and which is portable and weighs under 30 pounds.

It is also a further object of the invention to provide a knee stretching machine for physical therapy which can be used bilaterally on each knee of the body and can as well be adjusted to individual body heights.

BRIEF DESCRIPTION OF THE DRAWINGS

The details of a typical, but not limiting, embodiment of the present invention to be viewed and comprehended in light of the doctrine of equivalents will be described in connection with the accompanying drawings in which.

DESCRIPTION OF THE PREFERRED EMBODIMENT

Figure 1:
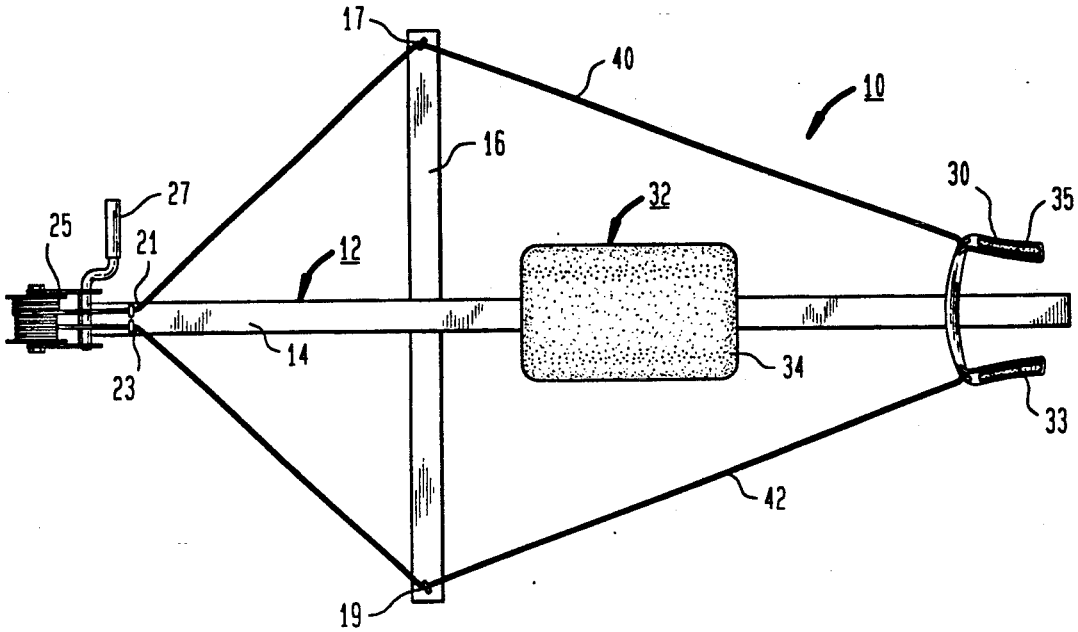
FIG. 1 is an elevational plan view of a knee stretching machine of the present invention.

Referring initially to FIG. 1 there is shown a plan view of a knee stretching machine 10 for therapeutic bending of the knee joint. The knee stretching machine 10 has a cruciform member 12. The cruciform member 12 is made of a body length shaft 14 (which substantially exceeds the length of an average human body) connected to a transverse member 16. The transverse member 16 has an eyelet 17 located on the right arm thereof and another eyelet 19 located on the left arm thereof. The body length shaft 14 has a right eyelet 21 and a left eyelet 23 located in front of a means for providing a force knee bending and/or stretching, for example winch 25. The winch 25 is actuated by a handle 27. Harnessing means, e.g., an ankle collar 30, is located aft of the transverse member 16 in between the ankle collar 30 and the transverse member 16 there is slidably mounted on the body length shaft 12, a thigh seat 32, for example. As an option the thigh seat 32 is adapted to be movable, for example slidably mounted on the body length shaft 14. The thigh seat 32 is contoured an adapted to receive the thigh of a patient lying prone on top of the cruciform member 12 and is adapted with padding 34.

There is also shown in FIG. 1 two hook and loop fasteners 33 and 35, for example. The ankle collar 30 is an elongated strap with one of the hook and loop fasteners 33 and 35 located on each end whereby the fastener 33 is adapted to interconnect with the fastener 35 as the collar 30 is adjusted around an ankle of a patient (not shown).

In FIG. 1 the ankle collar 30 is shown with its right side connected to the right side of the winch 25 via a rope 40 which is threaded through the eyelet 17 and subsequently through the eyelet 21 to the winch 25. The left side of the ankle collar 30 has a rope 42 attached and interconnected to the winch 25 via the eyelet 19 and then through the eyelet 23 wherein by turning the crank 27 obliquely vectored forces are exerted on the ankle collar 30. The ankle collar 30 is pulled rotationally forward towards the winch 25 without any lateral movement to the left or right because the lateral force vectors are cancelled.

Figure 2:
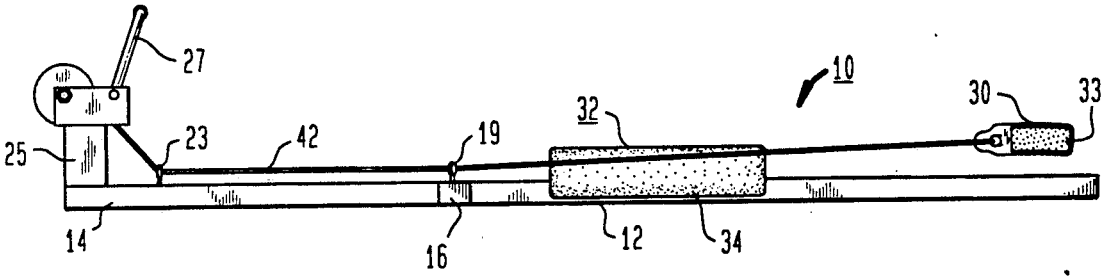
FIG. 2 is a side elevational view of the knee stretching machine shown in FIG. 1.

There is shown in FIG. 2 a side view of the knee stretching machine 10 made up of the winch 25 connected and mounted on the horizontally oriented cruciform member 12. The transverse member 16 is shown with the eyelet 19 mounted thereon. The body length shaft 14 is oriented perpendicular to the transverse member 16 and is shown with the eyelet 23 mounted thereon. The ankle collar 30 is connected to the winch 25 via rope 42 which extends through the eyelet 19 ad then thru the eyelet 23 and then connected to the winch 25. The thigh seat 32 is movably engaged on the body length shaft 14 in the aft position with a hook and loop fastening means, for example. The winch is permanently located in the formed position at the fore end of the body length shaft 14.

Figure 3:
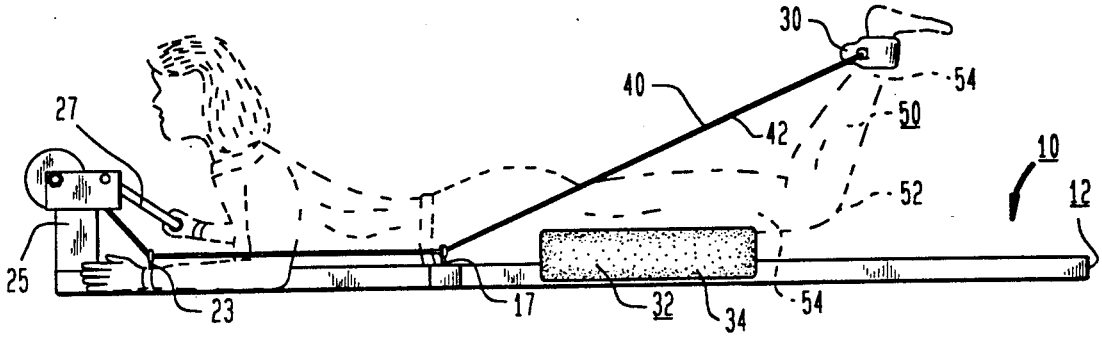
FIG. 3 is a side elevational view of the knee stretching machine shown in FIG. 2 being used by a patient, specifically illustrating the manner in which the machine is used.

There is shown in FIG. 3 a patient 50 using the knee stretching machine 10. The patient's knee 52 is being stretched by two equal oblique forces from the winch 25 independently applied to the ankle 54 of the person via the ropes 40 and 42. The person's thigh 54 is cradle din the thigh seat 32 which si slidably mounted, for example, on the cruciform member 12. A person 50 is shown lying prone face down on top of the cruciform member 12 with the thigh 54 resting comfortably on the padded thigh seat 32.

Figure 4:
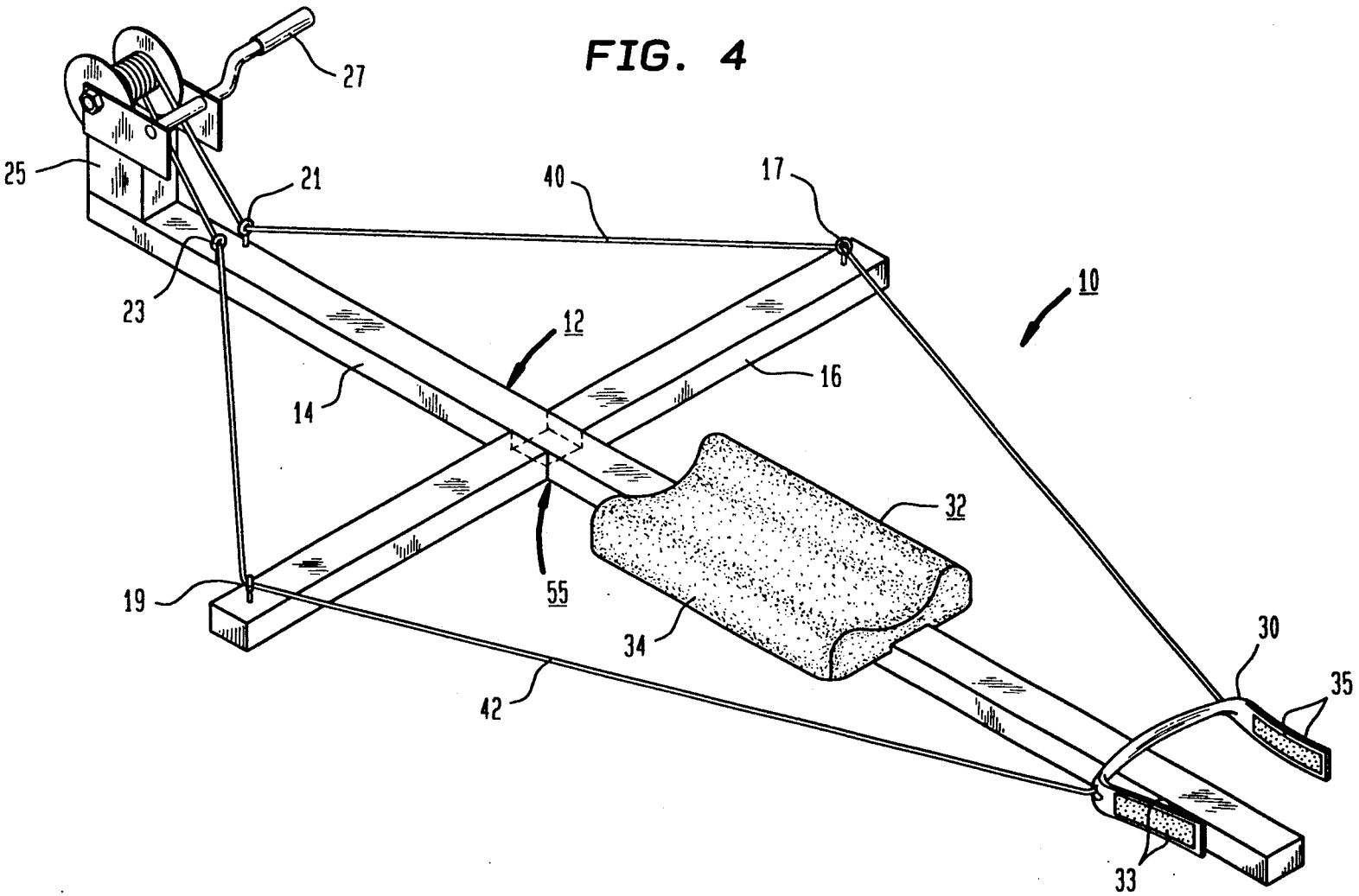
FIG. 4 is an isometric view of the knee stretching machine of the novel invention.

There is shown in FIG. 4 a prospective view of the knee stretching machine 10. Alternatively, the knee stretching machine 10 may be mounted on a table wherein the cruciform member 12 either rest on the table or is permanently mounted to the table. Shown in FIG. 4 is the body length shaft 14 of the cruciform member along with the transverse member 16. The transverse member 16 and the shaft 14 are adapted to be disassembled at the juncture 55.

The ankle collar 30 is shown adapted with hook and loop fasteners 33 and 35 at each end, for example. The hook and loop fasteners 33 and 35, of Velcro, for example, may be located on both the inside and outside surfaces of the ankle collar 30 to facilitate easy adjustable connection around the ankle of a patient or user. The thigh seat 32 is mounted on the body length shaft 14 in the aft position in between the transverse member 16 and the ankle collar 30. The thigh seat 32 is adapted with a slot underneath (not shown) that receives the upper half of the body length shaft 14 so that it may be disassembled from the knee stretcher machine 10 by simply lifting off. The transverse member 16 is connected to the body length shaft 14 by a standard notch assembly at the crossing juncture 55, for example. Thus, the transverse member 16 may be disassembled from the body length shaft 14 simply by disengaging same. The winch 25 is mounted on the shaft 14 via a bracket and plurality of bolts (not shown) in standard fashion. The eyelets 21 and 23 are attached to the shaft 14 by being screwed into apertures therein. The shaft 14 and transverse member 16 are made of wood, for example. The eyelet 17 and 19 are similarly screwed into apertures in the transverse member 16.

The present invention is not limited to the stretching of only one of the user's legs but may be employed to stretch each of the user's knees in succession. Of course, appropriate modifications of the size and location of some of the components of the present invention described above may be necessary when adapting the present invention for use by small children or very large individuals.

As will be apparent to those skilled in the art to which the invention is addressed, the present invention may be embodied in forms other than that specifically disclosed above without departing from the spirit or essence or central characteristics of the novel invention. Therefore, the articulated embodiment of the knee stretching machine described above is to be considered in all respects as being merely an illustration of a constructed embodiment of the invention tested and shown capable of carrying out the present invention. The scope of the preset invention is as set forth in the appended claims, rather than being limited to the foregoing description.

What is claimed is:

1. A portable stretching machine for therapeutic flexing of the knee comprising an ankle collar, a winch, a portable horizontal cruciform member, the horizontal cruciform member comprising a first longitudinal member crossed perpendicularly by a second longitudinal member, the second longitudinal member having a first arm extending transversely from one side of said first longitudinal member, the second longitudinal member further comprising a second arm extending transversely from a second side of said first longitudinal member, the horizontal cruciform member further comprising a bottom surface adapted to lay on a support surface and a top surface adapted to support a suer, the second longitudinal member perpendicular to the first longitudinal member and removably attached to the first longitudinal member between the ends of the first longitudinal member, the horizontal cruciform member having a means for exerting a knee bending force including said winch attached near a first end of said first longitudinal member and an ankle harnessing means including said ankle collar located near a second end of said first longitudinal member, said second end of said first longitudinal member being opposite said first end, a first independent connecting means which connects a first side of the ankle collar to a first side of the force means via a first eyelet in front of the winch and a second eyelet on the first arm of the cruciform member, a second independent connecting means which connects a second side of the ankle harnessing means to a second side of the force means via an eyelet on the second arm of the cruciform member, and a thigh seat adapted to slide on the top surface of the first longitudinal member, the thigh seat being located between the winch and the ankle harnessing means, the thigh seat being adapted to support a thigh and adjoining ankle of a prone person with the adjoining ankle fixed in the ankle harnessing means

2. The stretching machine of claim 1 wherein the thigh seat is contoured to receive a thigh and wherein the thigh seat is padded.

3. The stretching machine of claim 2 wherein said force means comprises a handle attached to the winch ad wherein the winch is affixed to the cruciform member.

4. The stretching machine of claim 3 wherein the cruciform member is made of a rigid inflexible material and is adapted to be elevated onto a table.

5. The stretching machine of claim 4 wherein the eyelets are permanently affixed to the cruciform member.

6. The stretching machine of claim 5 wherein said ankle collar is adapted to fit around a variety of sizes of ankles via an adjustable fastening means.

7. The stretching machine of claim 1 wherein the cruciform member has means for disassembling into a plurality of longitudinal members for storage and transporting.

8. A knee bending machine comprising a portable platform comprising a cruciform member which includes a longitudinal member, comprising a bottom surface adapted to lay on a support surface and a top surface adapted to support the user, with a first end and a second end and a transverse member perpendicular to the longitudinal member and removably attached to the longitudinal between the ends of the longitudinal member, the longitudinal member having attached thereto a force means for exerting a nonlateral knee bending force on a knee joint of a person lying prone on said platform, said force means being attached near the first end, an ankle harnessing means being located near the second end, said ankle harnessing means being connected to said force means via a plurality of independent ropes, one of said ropes being directed laterally to the left of the person around the left side of the person thru a conduit and connected to said force means, another of said ropes being directed laterally to the right other person around the right side of the person thru a conduit and connected to said force means, said force means being adapted to manually provide a measured directional knee bending force commensurate with an input of mechanical energy, and a thigh seating means slidably mounted on said longitudinal member and located between said force means and the ankle harnessing means and further adapted to support a thigh of a prone person with an adjoining ankle fixed in the ankle harnessing means.

9. The knee bending machine of claim 8 wherein said thigh seat is padded and contoured.

10. The knee bending machine of claim 9 wherein said thigh seat is slidably detachably mounted on said platform.

* * * * *